United States Patent [19]

Davila et al.

[11] 4,360,034

[45] Nov. 23, 1982

[54] COIN SORTER-COUNTER

[75] Inventors: Jose E. Davila; Efrain A. Davila, both of Bourbonnais; Jim H. Gomez, Kankakee, all of Ill.

[73] Assignee: Joseph C. Gianotti, Trustee, Kankakee, Ill.

[21] Appl. No.: 138,714

[22] Filed: Apr. 9, 1980

[51] Int. Cl.[3] ..... G07D 3/02

[52] U.S. Cl. ..... 133/3 D; 133/3 H; 133/8 R; 221/182

[58] Field of Search ..... 133/1 R, 3 R, 3 D, 3 E, 133/3 G, 3 H, 8 R; 221/21, 182; 222/56

[56] References Cited

U.S. PATENT DOCUMENTS

| | | | |
|---|---|---|---|
| 918,273 | 4/1909 | Brewster | 133/8 R |
| 1,095,981 | 5/1914 | Farrell | 133/3 E |
| 1,655,412 | 1/1928 | Donnellan | 133/3 E |
| 1,664,310 | 3/1928 | Murray | 133/3 H |
| 1,894,190 | 1/1933 | Myers | 133/8 R X |
| 2,289,002 | 7/1942 | Fleming et al. | 133/8 R |
| 3,343,462 | 9/1967 | Sexstone | 222/56 X |
| 3,409,116 | 11/1968 | O'Malley | 221/21 X |
| 3,603,327 | 9/1971 | Buchholz | 133/8 R |
| 4,210,801 | 7/1980 | Gomez et al. | 406/133 X |
| 4,275,751 | 6/1981 | Bergman | 221/182 X |

*Primary Examiner*—F. J. Bartuska

*Attorney, Agent, or Firm*—Dithmar, Stotland, Stratman & Levy

[57] ABSTRACT

A coin sorter-counter comprising a stack of plates mounted for rotation about an axis inclined to the horizontal with a housing therearound having coin openings therein, coin pockets arranged around each plate for catching coins, a resilient wheel for each of the plates to move coins from the pockets through the housing openings, and coin sensors associated with each of the coin openings for counting the coins passing therethrough; also provided is overload protection for each of the coin sorting plates, and a sensor for detecting jams and reversing the drive motor to clear the jam.

23 Claims, 10 Drawing Figures

FIG. 4
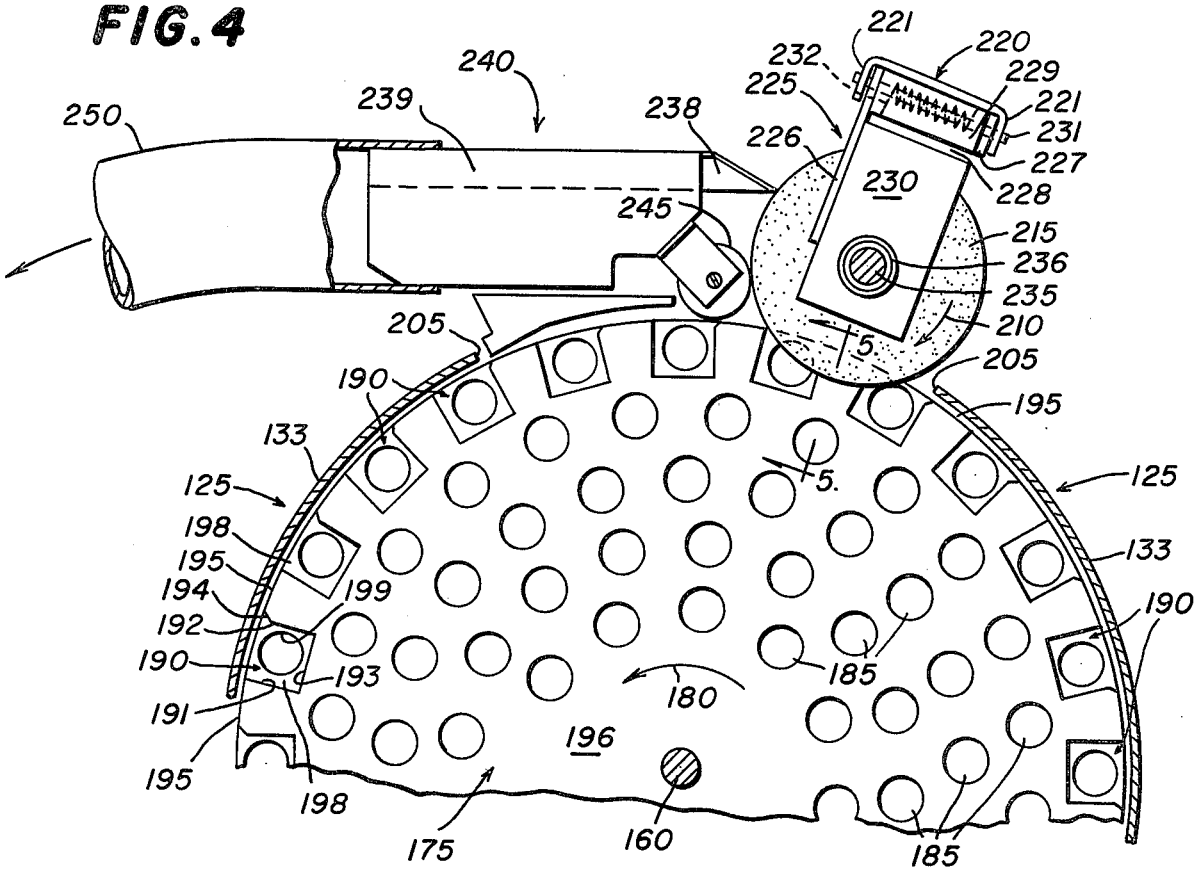
FIG. 5
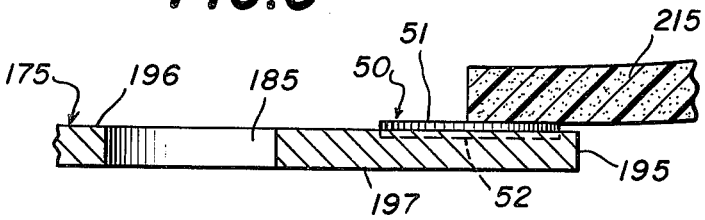
FIG. 8
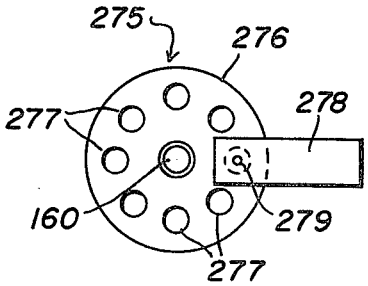
FIG. 6
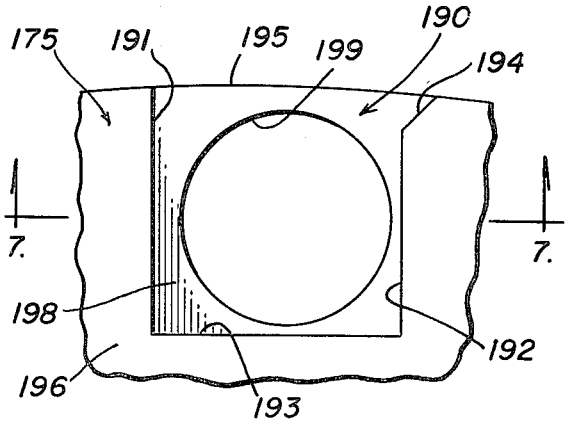
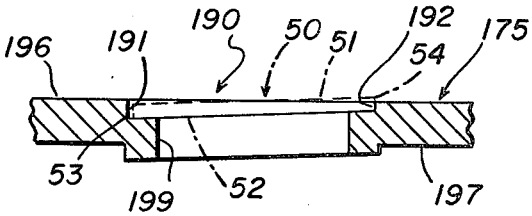
FIG. 7

COIN SORTER-COUNTER

PRIOR ART STATEMENT AND BACKGROUND OF THE INVENTION

The present invention relates to coin sorter-counters of the type including a plurality of stacked plates having openings therein to sort the coins, and specifically to the provision of an improved design of pockets on the plates and an improved ejector system for removing coins from the pockets, and improved overload and jam protection systems.

The present invention is an improvement upon the coin sorter-counter that is disclosed and claimed in an application for United States Letters Patent Ser. No. 855,970 filed Nov. 30, 1977 by Jim H. Gomez and Jose E. Davila now U.S. Pat. No. 4,210,801, and the pertinent portions of the disclosure of that prior application are incorporated herein by reference. The coin sorter-counter of the present invention provides for a more rapid and more sure sorting and counting of the coins as compared to the above application and provides in addition protection against overloading of the sorting plates and mechanism to sense a stopping or jamming of the sorting plates with automatic clearance effort thereafter. There also is disclosed as an improvement over the prior patent application the mechanism for automatically counting a predetermined number of a single denomination of coins and stopping operation thereafter.

Other exemplars of coin sorting and counting devices utilized heretofore are illustrated in U.S. Pat. No. 1,095,981 granted May 5, 1914 to J. J. Farrell, U.S. Pat. No. 1,655,412 granted Jan. 10, 1928 to E. P. Donnellan and U.S. Pat. No. 2,289,002 granted July 2, 1942 to R. B. Fleming et al. None of these prior patented coin sorter-counters can rapidly sort and count coins in a few seconds accurately and without jamming.

BRIEF SUMMARY OF THE INVENTION

The present invention provides a coin counter-sorter which counts coins more accurately and faster while incorporating protection for the coin sorter-counter against overloading and jamming.

This is accomplished in the present invention, and it is an object of the present invention to accomplish these desired results, by providing a coin sorter including a stack of plates mounted for rotation about an axis inclined to the horizontal, the number of plates being at least equal to the number of different sizes of coins to be sorted, a housing surrounding at least the periphery of the plates for keeping the coins being sorted thereon, each of the plates having a plurality of openings therein of a size slightly smaller than the size of the coins to be retained thereon, the openings in the plates increasing in size from the bottommost plate upwardly to the topmost plate, a coin entry chute disposed above the uppermost plate for depositing a mixture of different sizes of coins thereon, coin receiving pockets arranged around each plate adjacent to the outer periphery thereof for catching a coin along the lower portion of the path of travel of the plate and for carrying the coin upwardly and past the highest portion of the path of travel of the plate, a plurality of discharge openings through the housing respectively associated with each of the plates and disposed adjacent to the outer periphery of of the associated plate just below the highest portion of the path of travel thereof to receive the coins carried by the pockets one-by-one thereinto, and coin ejection means for each of the plates adjacent to the discharge openings for moving coins one-by-one from the pockets and into the associated discharge opening.

Another object of the invention is to provide a coin sorter of the type set forth wherein the coin receiving pockets are formed by recesses arranged around each plate adjacent to the outer periphery thereof and extending to the periphery of the associated plate.

Still another object of the invention is to provide a coin sorter of the type set forth wherein the ejection means is a plurality of resilient wheels each rotatably mounted adjacent to one of the plates adjacent to the associated discharge opening and engaging coins disposed in the pockets for moving the coins one-by-one from the pockets and into the associated discharge opening.

Yet another object of the invention is to provide a coin sorter-counter incorporating a coin sorter of the type set forth and further including a coin detector mounted adjacent to each discharge opening for counting each of the coins passing thereby.

Still another object of the invention is to provide a coin sorter-counter of the type set forth wherein a coin sensor is associated with each of the plates for detecting a quantity of coins on the associated plate sufficient to overload the coin sorter and for stopping the drive motor so that the overload condition can be corrected.

Yet another object of the invention is to provide a coin sorter-counter of the type set forth including means for detecting an interruption in the rotation of the plates in the event of a jam of the coins carried thereon and thereafter reversing the direction of rotation of the drive motor to clear the jam and permit continued rotation of the plates and continued operation of the coin sorter-counter.

A further object of the invention is to provide a coin sorter-counter of the type set forth incorporating structure for counting a predetermined number of coins of one denomination and stopping operation of the coin sorter-counter when the predetermined number has been counted so that the predetermined number of coins can be removed before counting resumes.

A still further object of the invention is to provide a coin sorter-counter of the type set forth including mechanism for totalizing the value of the coins counted, and also incorporating mechanism to permit the addition of other sums to the accumulated value.

Further features of the invention pertain to the particular arrangement of the parts of the coin sorter-counter, whereby the above-outlined and additional operating features thereof are attained.

The invention, both as to its organization and method of operation, together with further features and advantages thereof will best be understood with reference to the following specification taken in connection with the accompanying drawings.

BRIEF DESCRIPTION OF THE DRAWINGS

FIG. 4 is a fragmentary view on an enlarged scale in section along the line 4—4 of FIG. 2;

FIG. 5 is a further enlarged fragmentary view in vertical section along the line 5—5 of FIG. 4;

FIG. 6 is a fragmentary enlarged view of one of the coin recesses or pockets on the sorting plate illustrated in FIG. 4;

FIG. 7 is a view in section along the line 7—7 of FIG. 6;

FIG. 8 is a view in section along the line 8—8 of FIG. 2 and showing the coin plate rotation sensor;

DETAILED DESCRIPTION OF THE PREFERRED EMBODIMENT

Figure 1:
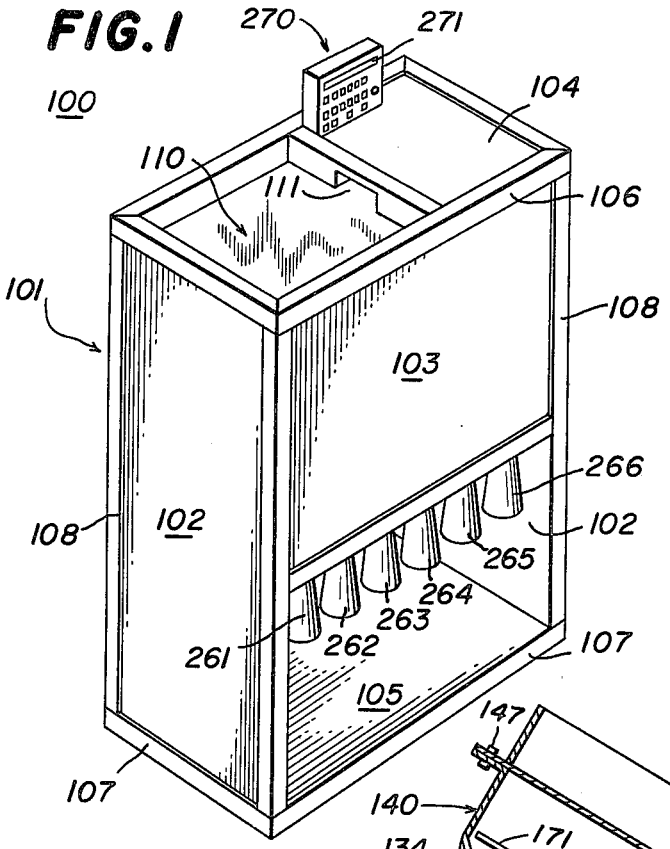
FIG. 1 is a perspective view of a coin sorter-counter made in accordance with and embodying the principles of the present invention.
Figure 3:
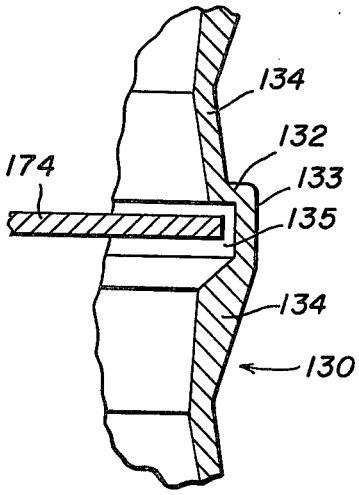
FIG. 3 is an enlarged fragmentary view showing the relationship between the sorter housing and one of the sorting plates associated therewith.

There is illustrated in FIG. 1 of the drawings a coin sorter-counter 100 made in accordance with and embodying the principles of the present invention. As illustrated, the coin sorter-counter 100 includes an exterior cover or housing 101 including opposed end panels 102 joined by a front panel 103 and a bottom panel 105, a partial top panel 104 also being provided. The various panels are joined at the meeting edges by a top edging 106, a bottom edging 107 and a side edging 108. Adjacent to the partial top panel 104 is a tray or hopper 110 in which coins to be counted are deposited, the coins in the hopper 110 being fed therefrom through an opening 111 into the interior of the coin sorter-counter 100 for sorting and counting purposes.

Disposed within the exterior housing 101 is a frame generally designated by the number 120 and including an inclined leg 121 mounted upon a horizontal intermediate panel 122 disposed within the exterior housing 101. An interior housing 125 is mounted on the frame 120 and more specifically includes a bottom plate 126 circular in shape and having a depending flange 127 therearound and supporting a plurality of spacers 128. Disposed upon the bottom plate 126 is a lower housing member 130 upon which in turn is disposed an upper housing member 140. The lower housing member 130 has an outturned bottom flange 131 which is received upon the spacers 128 and is secured in position by bolts 137. Extending upwardly from the bottom flange 131 is a wall portion 133 normal to the bottom flange 131 and carrying on the upper edge thereof an inwardly directed flange 132 normal to the flange 131. Extending upwardly from the inner edge of the flange 132 is a wall portion 134 that in turn terminates in a wall portion 133 carrying an inturned flange 132. In all there are three of the inturned flanges 132 and the lower housing member 130 carries on the upper edge thereof an outwardly directed top flange 136.

The upper housing member 140 has an outturned bottom flange 141 resting upon the outturned top flange 136 of the lower housing member 130 and suitably secured thereto as by a plurality of bolts 138. The upper housing member 140 includes a wall portion 143 normal to the bottom flange 141 and carrying thereon an inturned flange 142 normal thereto and in turn carrying an upstanding and slightly outwardly inclined wall portion 144. Two of the inturned flanges 142 are provided and the upper end of the upper housing member 140 carries an outturned top flange 146 extending therearound. A top plate 150 is provided that overlies the top flange 146 and is secured thereto by a plurality of bolts 147. Extending upwardly from the top plate 150 is an annular plate 151, the top plate 150 having an opening 156 therein that receives coins from the hopper 110 through the opening 111.

A main drive shaft 160 is provided and is journalled in the housing 125, a first bearing 161 being provided and mounted on the bottom plate 126 and a second bearing 162 being provided on and mounted on the top plate 150. A motor mount bracket 162 is provided below the bottom plate 126 and mounted thereon is an electric drive motor 165. The output from the motor 165 drives a gear box 166 having an output shaft 167 on which is mounted a gear 168. The gear 168 meshes with a second gear 169 that is fixedly secured to the bottom of the drive shaft 160.

A plurality of hubs 170 is fixedly secured to the drive shaft 160 at equidistantly spaced points therealong, six of the hubs 170 having been shown for illustrative purposes. Each of the hubs 170 has fixedly secured thereto a coin sorting plate, six of the coin sorting plates having been provided and numbered from top to bottom 171 through 176 respectively. The six plates illustrated are adapted to sort United States coins in denominations of 50¢, $1.00, 25¢, 5¢, 1¢ and 10¢; it will be appreciated that other types of coins and even tokens and the like can be sorted and counted using the coin sorter-counter 100, provided that suitable sorting plates with holes the appropriate size are provided. As illustrated, the sorting plates 171 through 176 are formed flat and each is essentially covered by a plurality of openings 181 to 186, respectively, only certain of the openings 181 to 186 being visible in the patent drawings. The openings in the plate 171 are the largest and the openings in the plate 176 are the smallest, the openings in the plate 171 being large enough to pass all coins except 50¢ pieces, and the openings in the plate 176 being smaller than the smallest coin to be sorted, namely, the 10¢ piece. Accordingly, when a mixture of coins is introduced via the chute 155 into the housing 125, the 50¢ pieces are retained on the sorting plate 171, the $1.00 pieces are retained on the sorting plate 172, the 25¢ pieces are retained on the sorting plate 173, the 5¢ pieces are retained on the sorting plate 174, the 1¢ pieces are retained on the sorting plate 175, and the 10¢ pieces are retained on the sorting plate 176. In order to ensure that the various coins do not escape from the sorting plates 171 through 176 around the periphery thereof, the peripheries of the sorting plates 171 to 173 are disposed in recesses 145 formed in the walls of the upper housing member 140 by the flanges 142 and the wall portions 143, while the peripheries of the sorting plates 174 to 176 are received in recesses 135 formed in the wall of the lower housing member 130 by the flanges 132 and the wall portions 133.

In addition to the openings 181 to 186 formed respectively throughout the areas of the corresponding sorting plates 171 to 176, there are provided around the periphery of each of the sorting plates a pocket or recess shaped and sized to receive the coins to be retained on that sorting plate. As illustrated in FIG. 4 of the drawings the construction of the pockets or recesses for the sorting plate 175, these recesses being generally designated by the number 190 and various details of construction also being illustrated in FIGS. 5 to 7 of the drawings. It will be seen from FIGS. 4 and 6 that each of the recesses 190 is essentially square in shape and extends radially outwardly to the periphery 195 of the sorting plate 175. The recess 190 is formed in the plate 175 by a forging or upsetting process wherein the upper surface 196 of the plate 175 is displaced downwardly as is the bottom surface 198, see FIG. 7, in the area of the recess 190. Each of the recesses 190 has a leading edge 191, i.e., an edge disposed in the direction of rotation of the coin plate 175, that being the direction of the arrow centrally thereof in FIG. 4, and a trailing edge 192 disposed substantially parallel to the leading edge 191 but spaced therefrom in the direction opposite to the direction of rotation of the plate 175. An inner edge 193 is provided normal to the edges 191 and 192, and the outer portion of the edge 192 is beveled to provide an inclined edge 194 extending to the periphery 195. The recess 190 has a bottom surface 198 that is slightly inclined with respect to the surfaces 196 and 197 of the plate 175, the inclination being downwardly in the direction of rotation of the plate 175, whereby the leading edge 191 has a greater depth than the trailing edge 192, see FIG. 7 particularly. Each of the recesses 190 has an opening 199 therein that is the same size and shape as the openings 185. From FIGS. 5 and 7 it also can be seen that the leading edge 191 has a depth greater than the thickness of an associated coin 50 that is to be sorted upon the plate 175, whereas the trailing edge 192 has a depth less than the thickness of the coin 50. The coin 50 has an upper surface 51 and a lower surface 52 and when disposed in the associated recess 191 has a leading edge 53 and a trailing edge 54. It will be seen therefore from FIG. 7 that the leading edge 53 of the coin 50 is disposed well below the surface 196 of the plate 175, while the trailing edge 54 of the coin 50 extends well above the upper surface 196 of the plate 175, whereby but a single coin 50 can be accommodated in each of the recesses 190.

Figure 2:
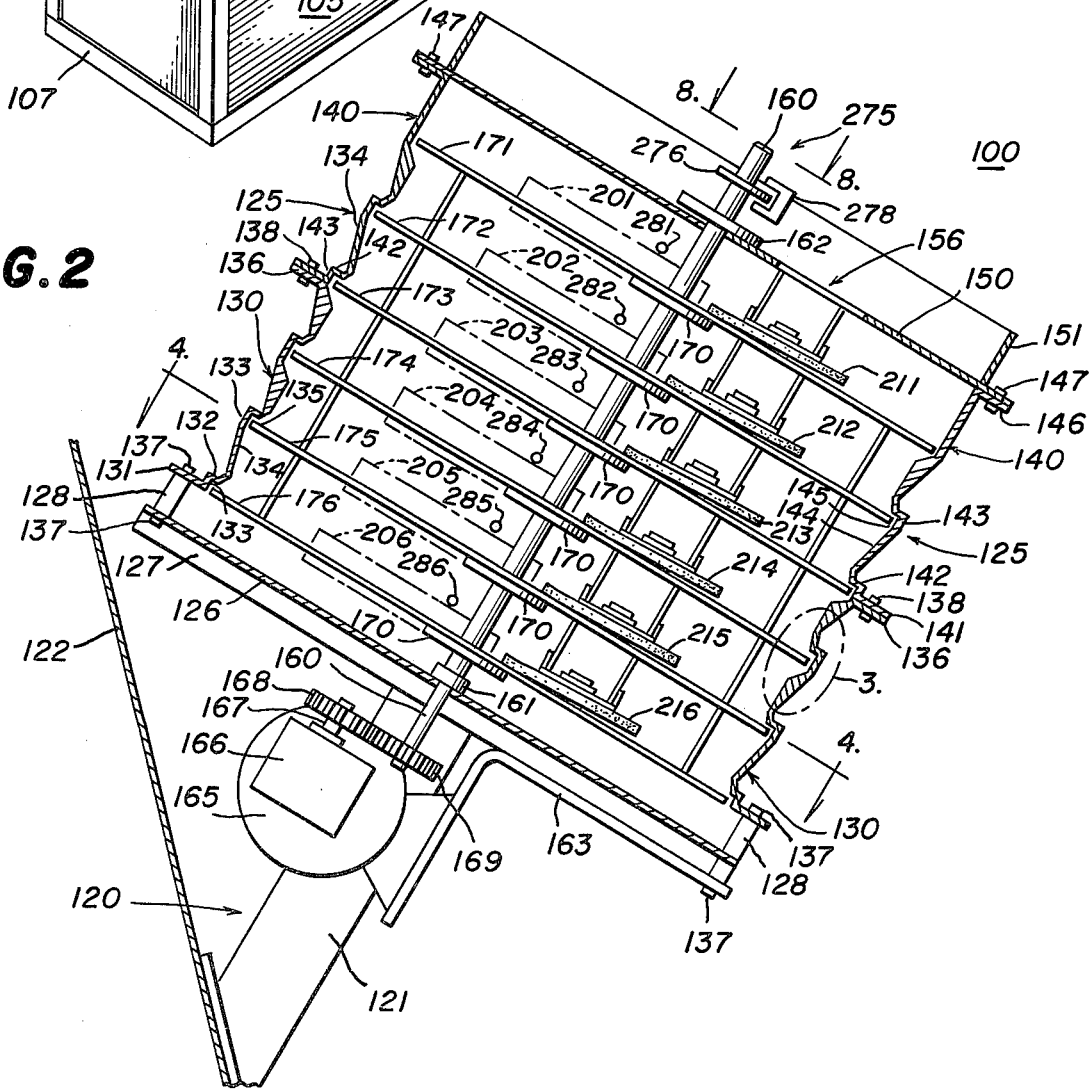
FIG. 2 is a view in section with certain portions broken away through the coin sorter-counter of FIG. 1.

The pockets 190 in the sorting plates 171 pick up the proper denomination of coin as the pockets 190 arrive at the lowermost portion of the path of travel thereof, i.e., to the right as viewed in FIG. 2. As the plates rotate in the direction of the arrow 180 in FIG. 4, the trailing edge 192 in each of the pockets 190 engages the trailing edge 54 of the associated coin and moves the coin upwardly along the path of travel and to the left as viewed in FIGS. 2 and 4. If a second coin 50 attempts to be carried in the pocket 190, the second coin 50 will slide downwardly and out of the pocket 190 since the trailing edge 192 of the pocket has a depth less than the thickness of the trailing edge 54 of the coin 50. Accordingly, only one coin 50 will be in each of the pockets 190 as the pockets 190 move upwardly and to the left in FIG. 4 of the drawings. In order to permit removal of the coins 50 from the pockets 190, the housing members 130 and 140 have openings formed therein associated with each of the sorting plates 171 to 176, and more specifically, corresponding openings 201 to 206 are provided for the sorting plates 171 to 176, respectively. Extending into the openings 201 to 206 are coin removing wheels 211 to 216, respectively, the wheels 211 to 216 engaging the upper surfaces of the associated sorting plates 171 to 176, respectively, and being driven thereby in a clockwise direction as indicated by arrow 210 in FIG. 4. Referring particularly to FIGS. 4 and 5 of the drawings, it will be seen that the wheels 211 to 216 are mounted upon a mounting bracket generally designated by the numeral 200 and having two side flanges 221 parallel to each other and extending toward the periphery of the associated sorting plates. The mounting bracket 220 is fixedly mounted upon the housing members 130-140, but each of the wheels 211 to 216 is mounted for pivotal shifting with respect to the mounting bracket 220. To this end, each of the wheels 211 to 216 is provided with a pivot arm, the mounting and arrangement of the wheel 215 in FIGS. 4 and 5 being illustrative of the mounting of the wheels 211 to 216. As illustrated, the wheel 215 is provided with a pivot arm generally designated by the numeral 225 and including an elongated flange 226, a short flange 227 and a transverse slot 228 providing a hinge plate 229 and a support plate 230. The short flange 227 is on the hinge plate 229 as is a portion of the long flange 226, the flanges 226 and 227 having aligned openings therein receiving a shaft 231 extending through aligned openings in the side flanges 221 pivotally to mount the pivot arm 225 upon the mounting bracket 220. A spring 232 is provided acting between the mounting bracket 220 and the pivot arm 225 to press the support plate 230 downwardly toward the associated sorting plate 175.

The support plate 230 carries a vertically extending shaft 235 mounted in a bearing 236 on the support plate 230, and the wheel 215 is fixedly secured to the shaft 235. The support plate 230 can be positioned by bending with respect to the longitudinal flange 226 so that the wheel 215 is canted with respect to the surface of the associated sorting plate 175 (see FIG. 2 also) at an angle of about 5°, with the portion of the wheel 215 disposed to the left in FIGS. 2 and 4 being pressed against the associated sorting plate 175, and with the portion of the wheel 215 disposed to the right being elevated above the surface of the associated sorting plate 175. As is best seen in FIGS. 4 and 5, the wheel 215 is pressed against the upper surface 51 on the coin 50 as the coins come into alignment with the associated opening 205 and the wheel 215 is rotated in the direction of the arrow 210 which is in a direction to pull the engaged coin 50 radially outwardly across the periphery 195 of the sorting plate 175 and out of the coin pocket 190.

As the coins 50 are pulled by the wheel 215 out of the pocket 190 and through the opening 205, the coins 50 are directed into a track 240 including side walls 238 and top and bottom walls 239, the track having a hose 250 connected thereto and receiving the coins and delivering the coins to an associated one of the coin outlets 261 to 266 disposed above the bottom panel 105 and spaced therefrom, (see FIG. 1), suitable containers for the sorted and counted coins being engageable with the outlets 261 to 266 to collect the sorted and counted coins with the 50¢ pieces issuing through the outlet 261, the $1.00 pieces issuing through the outlet 262, the 25¢ pieces issuing through the outlet 263, the 5¢ pieces issuing through the outlet 264, the 1¢ pieces issuing through the outlet 265 and the 10¢ pieces issuing through the outlet 266. In this fashion, it will be seen that the coins will be sorted by denomination and delivered to the outlets 261 to 266 where the sorted coins will be discharged into suitable containers engaging the outlets 261 to 266.

As the coins are pulled by the wheels 211 to 216 from the pockets 190 in the sorting plates 171 to 176, the coins pass by coin detecting sensors 241 to 246, respectively, the sensor 245 being provided in association with the sorting plate 175, it being understood that like sensors are provided for the other sorting plates 171 to 174 and 176. As illustrated, the coin sensor 245 includes a light emitting diode with a photosensor, a count being made each time the light beam is interrupted by a coin 50 leaving the associated pocket 190 and passing by the sensor 245. In this fashion, each of the coins leaving the sorting plates 171 to 176 is counted by sensors such as the sensor 245 associated with the sorting plate 175.

Figure 9:
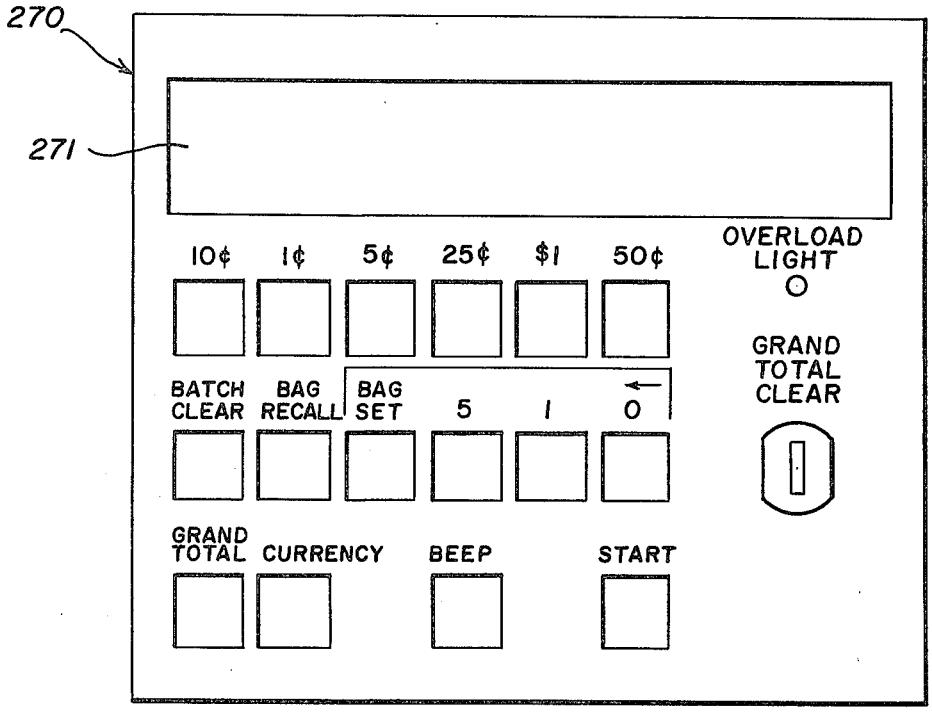
FIG. 9 is an enlarged elevational view of the control panel for the coin sorter-counter of FIG. 1.

There is mounted on the top panel 104 of the coin sorter-counter 100 a control panel 270 containing the controls for operating the coin sorter-counter 100. Details of the construction of the control panel 270 are best illustrated in FIG. 9. The control panel 270 is essentially rectangular in shape and extending across the upper portion thereof is a digital read-out panel comprising an array of light emitting diodes, the digital read-out panel 271 displaying the total value of the coins counted by the coin sorter-counter 100 for each counting operation. Disposed immediately below the digital read-out display 271 is a horizontal row of push bottons that are designated from left to right for 10¢ pieces, 1¢ pieces, 5¢ pieces, 25¢ pieces, $1.00 pieces and 50¢ pieces, these push buttons being used to set a predetermined count for each of the denominations noted. Below the denomination push buttons in the first row of push buttons is a second row of push buttons labeled from left to right "Batch Clear", "Bag Recall", "Bag Set", "5", "1", "0". To the right of the second row of push buttons is a key actuated switch labeled "Grand Total Clear". Finally, a bottom row of push bottons is provided labeled from left to right "Grand Total", "Currency", "Beep" and "Start".

Apparatus is provided to detect a jam in the coin sorter-counter, i.e., a stoppage of the rotation of the sorting plates 171 to 176. To this end, a motion detector 275 is provided on the upper end of the drive shaft 160 (see FIGS. 2 and 8), and includes a plate 276 having a plurality of openings 277 arranged therearound, eight of the openings 277 having been illustrated equiangularly arranged around the plate 276. A light source and detector 278 is provided in the form of a U-shaped yoke having one arm disposed below the plate 276 and carrying a light source, and a second arm overlying the plate 276 and including a light detector 279. So long as the disc 276 is rotating with the drive shaft 160, the light source and detector 278 register a periodic interruption of the light source. If the drive shaft 160 is stopped, indicating a jam in the coin sorter-counter 100, the light source and detector 278 will no longer have the light beam periodically interrupted as detected by the detector 279 and this will cause, through circuitry to be discussed more fully hereinafter, the drive motor 165 to be reversed from about $\frac{1}{8}$ to about 1/6 revolution, after which the drive motor 165 continues in the normal driving direction. If the jam persists, the light source detector 278 will detect this fact and the drive motor 165 will again be reversed from about $\frac{1}{8}$ to about 1/6 revolution, after which drive motor 165 will resume operation in the forward direction. If there is no clearing of the jam after three reversals of the drive motor 165, then an alarm is sounded in the control panel 270 and a signal is flashed on the control panel 270 to warn the operator that a jam has occurred.

There also is provided associated with each of the sorting plates 171 to 176 an overload sensor 281 to 286, respectively, mounted in the housing members 130 and 140 above the associated sorting plates 171 to 176. The overload sensors 281 to 286 detect an excessive quantity of coins on the associated one of the sorting plates 171 to 176, the overload sensors 281 being an electrical contact insulated from the associated housing member and connected to the control circuit to be described more fully hereinafter. Contact of the coins upon one of the sorting plates 171 to 176 with the associated overload sensor 281 to 286 causes a light to flash on the control panel 270 warning the operator to stop feeding coins until the overload condition has been rectified by additional sorting.

Figure 10:
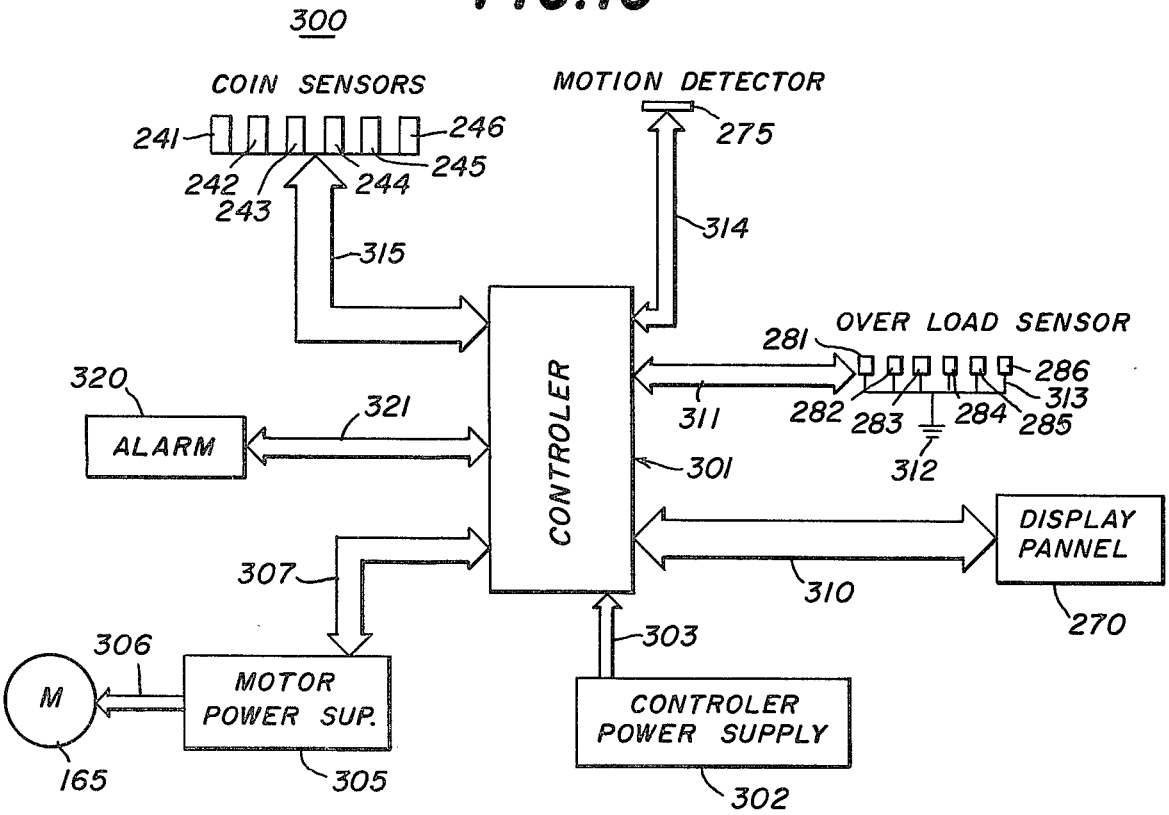
FIG. 10 is a diagrammatic view of the control circuit for the coin sorter-counter of FIG. 1.

There is illustrated in FIG. 10 of the drawings a control circuit 300 for the coin sorter-counter 100. As illustrated, the control circuit 300 includes a controller 301 which is in the form of a computer microprocessor with associated programming controlling the functions of the controller 301 including the sensing of the input thereto and the direction and control of the output therefrom. A controller power supply 302 is provided connected by suitable connections 303 as an input to the controller 301. A separate motor power supply 305 is provided that is connected through a connection 306 to the drive motor 165, the motor power supply 305 also having control connections 307 to the controller 301. The display panel 270 is also provided with a plurality of connections generally designated by the numeral 310 connecting the display panel 270 to the controller 301. Each of the overload sensors 281 to 286 has a connection through a conductor 313 to ground designated 312, and also each of the overload sensors 281 to 286 is connected by a connection designated by the numeral 311 to the controller 301. The motion detector 275 is connected by conductors 314 to the controller 301. The overload coin sensors 241 to 246 are connected by a connector 315 to the controller 301. Finally, there is provided an alarm 320 which is connected to the controller 301 by means of connectors 321. In an illustrative example of the coin sorter-counter 100, the coin sorting plates 171 to 176 have a diameter of 12 inches and are rotated by the drive motor 165 at a rate of 37 revolutions per minute. This produces a rate of counting coins by the coin sorter-counter 100 of about 2,000 coins per minute. The axis of the drive shaft 160 is inclined at an angle of about 45° with respect to the horizontal, whereby the axes of rotation of the sorting plates 171 to 176 are also inclined at an angle of about 45° with respect to the horizontal. The angle of inclination with respect to the horizontal of the axis of rotation of the drive shaft 160 may be in the range from about 30° to about 75° with respect to the horizontal. Instead of being rotated at a rate of 37 revolutions per minute, the sorting plates 171 to 176 may be rotated at a rate from about 30 revolutions per minute to about 45 revolutions per minute. The peripheral speed of the sorting plates 171 to 176 is in the range from about 95 feet per minute to about 140 feet per minute, the preferred speed being about 116 feet per minute.

The wheels 211 to 216 must be resilient if they are to perform efficiently the function of extracting coins 50 from the pockets 190 in the coin plates 171 to 176. To that end, the wheels 211 to 216 are formed of a polyurethane resin having a Durometer hardness in the range from about 57 to about 65. The pressure exerted by the springs 232 is such as to provide a constant pressure between the wheels 211 to 216 and the associated coin plates 171 to 176.

In the operation of the coin sorter-counter 100, a mixture of coins is deposited in the hopper 110 and is manually fed by the operator through the opening 111 whereby the coins fall downwardly through the chute 155 and the opening 156 onto the top coin sorting plate 171. The coin sorting plate 171 is designed to retain the 50¢ pieces, and all the other coins fall through the openings in the coin plate 211 and eventually distribute themselves upon the underlying plates, the plates being rotated continually with the shaft 160 while the coins are falling onto and through the sorting plates 171 to 176. The sorting plate 176 is designed to retain 10¢ pieces thereon, any smaller debris falling through the plate 176 and onto the bottom plate 126.

The design of the coin-receiving pockets 190 in the sorting plates 171 to 176 results in an efficiency of pick up of coins by the pockets 190 in the range from about 80% to about 85%. In other words, 80% to 85% of the pockets 190 as they move upwardly from the lowermost portion of the path of travel thereof have coins 50 deposited therein in the proper position for contact with the associated wheels 211 to 216 so as to cause the coins in the pockets to be swept through the associated openings 201 to 206 in the housing.

To sort coins using the coin sorter-counter 100, the controller power supply 302 is actuated as is the motor power supply 305 (see FIG. 10). The operator using the appropriate key inserts it into the key actuated switch identified in FIG. 9 as "Grand Total Clear" and actuates the switch to clear any prior count as well as the visual display 271. Assuming that only the total value of the coins counted is desired, the operator pushes the push button labeled "Start" which begins operation of the coin sorter-counter 100 and lights the "Batch Clear" push button. The operator then pours a random mixture of coins into the hopper 110 and manually feeds them through the opening 111 from which they fall through the chute 155 to the opening 156 onto the top sorting plate 171. The coins quickly distribute themselves on the proper sorting plates 171 to 176 and are then fed one-by-one by the wheels 211 to 216 from the coin pockets 190 past the coin sensors 241 to 246. The coin sensors 241 to 246 feed the information through the connectors 315 to the controller 301 which in turn feeds appropriate information by the connectors 310 to the control panel 270, and specifically to the display panel 271 thereon where the total value of the coins sorted and counted is displayed. When a first batch of coins to be sorted and counted has been completely sorted and counted, the number of coins in each denomination can be determined by sequentially pushing the push button for each denomination in the top row of push buttons, pressing a denomination of push buttons displaying the total number of coins counted for that denomination on the display panel 271. After determining the number of coins counted for each denomination in the first batch, the operator presses the "Batch Clear" button and the total value of the coins counted in the first batch will be added to the grand total of value of coins counted. This process is repeated for each subsequent batch of coins to be sorted and counted. To determine the grand total at any time of coins sorted and counted to that point, the operator presses the "Grand Total" push button, and the grand total counted has the value thereof displayed on the display panel 271. If the grand total for each denomination is required, the operator simultaneously pushes the "Grand Total" push button and the appropriate denomination push button and the grand total for that denomination is displayed on the display panel 271. At the end of a counting period such as a day, the grand total is cleared by turning the "Grand Total Clear" key. The sorter-counter is turned off by again pressing the "Start" button.

If too many coins are fed onto one of the sorting plates 171 to 176, an overload condition occurs, and such an overload condition interferes with the transit of coins from the higher sorting plates to the overloaded plate and also interferes with the passage of coins from the overloaded sorting plate to a lower sorting plate, whereby to provide the possibility of a miscount of the coins on the overloaded sorting plate. When the level of coins on one of the sorting plates 271 to 276 approaches a level corresponding to an overload, the coins contact the associated overload sensors 281 to 286, respectively, and this signal is transmitted by the connectors 311 to the controller 301. The controller 301 in turn through the connectors 321 actuates the alarm 320, the alarm 320 emitting either an audible signal or a visual signal, or both. The operator upon receiving the alarm signal indicating an overload, momentarily interrupts feeding of coins into the hopper 110 and through the opening 111 until the overload condition has been eliminated as indicated by termination of the actuation of the alarm 320.

In the event of a jam that stops rotation of the main drive shaft 160, the jam sensor or motion detector 275 will detect that fact and convey a signal along the conductors 314 to the controller 301. The controller 301 reverses the drive motor 165 for a period of $\frac{1}{8}$ to 1/6 revolution, after which operation of the drive motor 165 in the normal direction is resumed. If operation in the normal direction of the drive shaft 160 resumes, this fact will be detected by the motion detector 275 and operation will continue normally. If after reversal, the operation of the drive motor 165 is still stopped as detected by the motion detector 275, then the controller 301 causes the motor 165 again to be reversed for $\frac{1}{8}$ to 1/6 revolution, after which operation resumes in the normal direction of rotation. After a predetermined number of unsuccessful attempts to clear the jam, for example after three unsuccessful attempts, the controller 301 by means of the connectors 321 actuates the alarm 320 which provides an audio signal or a visual signal, or both, to the operator to alert the operator that a jam has occurred. The operator then clears the jam and presses the "Beep" button. The operator then resumes operation of the sorter-counter 100 by pressing the "Start" push button.

It often is desired to sort, count and collect a predetermined number of coins of a single denomination, those coins being collected in containers disposed in cooperation with the outlets 261 to 266 described above. The control circuit 300 is designed to permit counting of a predetermined number of any denomination of coin and stopping of the sorting-counting operation when that predetermined number of a given denomination of coin has been counted and delivered to the container associated with the appropriate outlets 261 to 266. In order to set the control circuit 300 to the desired count, the operator presses the push button designated "Bag Set", which turns on the lights associated with the push buttons in the first row for each of the six denominations illustrated; the operator then presses the denomination push button for which the number of coins to be counted is to be present; this turns off the lights on all other denomination push buttons; this advises the operator that the circuit 300 is ready to set a predetermined count for any of the selected denomination. The operator then enters the number of coins to be counted for the first denomination by actuating the push button designated "5", "1" and "0". If 4,000 coins of a denomination are to be counted, then the push button "1" is pushed four times, after which the push button "0" is pushed three times, whereby to register the numeral "4,000" on the display panel 271.

The operator then pushes the "Bag Set" push button which then enters the desired count for the selected denomination and extinguishes the light on the associated 10¢ denomination push button and turns on the lights on the other denomination push buttons. The operator then repeats the operation for the next denomination total to be counted, for example 5,000 pennies are to be counted, then the push button "5" is pushed after which the push button "1" is pushed so as to put the number "6" in the display panel 271, after which the "0" push button is pushed three times to register "6,000" on the display panel 271. If the operator wishes to check the count entered for any denomination, the operator presses the push button labeled "Bag Recall" followed by the actuation of the appropriate denomination push button in the first row, and this causes the display of the count to be made in the display panel 271. Having set the number of coins to be counted for each denomination, the operator pushes the "Start" button and the coin sorter-counter 100 operates until the first denomination to approach the preset count is within five coins of the preset count, at which time the motor 165 is slowed to one-half its normal operating rate, and operation continued until the preset number of coins have been counted. When the preset number of coins has been counted, the armature to the motor 165 is grounded to stop the motor 165 and the "Beep" push button and the appropriate denomination push button are lighted. The operator now can collect the container with the preset number of coins therein below the associated outlets 261 to 266 and substitute an empty container. The operator then pushes the "Beep" push button twice and then the "Start" push button and operation continues until the next desired count is approached within five coins, at which time the operation is repeated.

Another feature of the coin sorter-counter 100 of the present invention is a provision for the addition of a separate count of currency to the count of coins displayed on the display panel 271. To enter the currency count, the "Currency" button is depressed and the amount of currency entered using the three push buttons labeled "5", "1" and "0". This will cause the amount of currency to be entered into the control circuit 300 and displayed upon the display panel 271. Then the "Batch Clear" push button is pressed and the "Currency" push button is pressed which turns off its light. Actuation of the "Grand Total" button will then add the "Currency" count to the coin count previously made and display the sum on the display panel 271.

The button labeled "Beep" when depressed turns on al of the light emitting diodes in the display panel 271 so as to verify that all of the light emitting diodes are operative so as to avoid a possible false reading, and also turns on all the push button lights to insure that they are operative. "Batch Clear" button when actuated not only clears a batch count, but also adds that batch count to the "Grand Total". At the end of a counting operation or at the end of a working day, the operator by means of the key switch "Grand Total Clear" can clear the totals from the control circuit 300 to ready the coin sorter-counter 100 for the next cycle of operation.

While there has been described what is at present considered to be the preferred embodiment of the invention, it will be understood that various modifications may be made therein, and it is intended to cover in the appended claims all such modifications as fall within the true spirit and scope of the invention.

What is claimed is:

1. A coin sorter comprising a stack of plates mounted for rotation about an axis inclined to the horizontal, the number of plates being at least equal to the number of different sizes of coins to be sorted, a housing surrounding at least the periphery of said plates for keeping the coins being sorted thereon, each of said plates having a plurality of openings therein of a size slightly smaller than the size of the coins to be retained thereon, at least certain ones of said openings being arranged adjacent to the outer periphery of said plate, the openings in said plates increasing in size from the bottommost plate upwardly to the topmost plate, a coin entry chute disposed upon the uppermost plate for depositing a mixture of different sizes of coins thereon, a plurality of recesses in the upper surface of each plate respectively surrounding said certain peripheral ones of said openings and providing coin receiving pockets having a depth less than the thickness of the associated plate and extending to the periphery thereof, each of said recesses catching a coin only of the size to be retained on the associated plate along the lower portion of the path of travel of the plate for supporting the coin on the plate and carrying the coin upwardly and past the highest portion of the path of travel of the plate, a plurality of discharge openings through said housing respectively associated with each of said plates and disposed adjacent to the outer periphery of the associated plate just below the highest portion of the path of travel thereof to receive coins carried by said recesses one-by-one thereinto, and coin ejection means for each of said plates adjacent to said discharge openings for moving coins one-by-one from said recesses beyond the periphery of the associated plate and into the associated discharge opening.

2. The coin sorter set forth in claim 1, wherein said recesses are equiangularly positioned around the peripheries of said plates.

3. The coin sorter set forth in claim 1, wherein the leading edge of each of said recesses is deeper than the associated coin to be received therein, and the trailing edge of each of said recesses is shallower than the coin to be received therein.

4. The coin sorter set forth in claim 1, wherein the trailing edge of each of said recesses is relieved at the periphery of the associated plate.

5. The coin sorter-counter of claim 1, wherein each of said recesses is generally rectangular in shape.

6. A coin sorter-counter comprising a stack of plates mounted for rotation about an axis inclined to the horizontal, the number of plates being at least equal to the number of different sizes of coins to be sorted, a housing surrounding at least the periphery of said plates for keeping the coins being sorted thereon, each of said plates having a plurality of openings therein of a size slightly smaller than the size of the coins to be retained thereon, at least certain ones of said openings being arranged adjacent to the outer periphery of said plate, the openings in said plates increasing in size from the bottommost plate upwardly to the topmost plate, a coin entry chute disposed upon the uppermost plate for depositing a mixture of different sizes of coins thereon, a plurality of recesses in the upper surface of each plate respectively surrounding said certain peripheral ones of said openings and providing coin receiving pockets having a depth less than the thickness of the associated plate and extending to the periphery thereof, each of said recesses catching a coin only of the size to be retained on the associated plate along the lower portion of the path of travel thereof for supporting the coin on the plate and carrying the coin upwardly and past the highest portion of the path of travel of the plate, a plurality of discharge openings through said housing respectively associated with each of said plates and disposed adjacent to the outer periphery of the associated plate just below the highest portion of the path of travel thereof to receive the coins carried by said pockets one-by-one thereinto, coin ejection means for each of said plates adjacent to said discharge openings for moving coins one-by-one from said pockets and into the associated discharge opening, and a plurality of coin sensors respectively associated with said discharge openings and sensing and counting the coins as the coins pass through said discharge openings.

7. The coin sorter-counter set forth in claim 6, wherein said recesses are equiangularly positioned around the periphery of said plates.

8. The coin sorter-counter set forth in claim 6, wherein the leading edge of each of said recesses is deeper than the associated coin to be received therein, and the trailing edge of each of said recesses is shallower than the coin to be received therein.

9. The coin sorter-counter set forth in claim 6, wherein the trailing edge of each of said recesses is relieved at the periphery of the associated plate.

10. A coin sorter comprising a stack of plates mounted for rotation about an axis inclined to the horizontal, a motor for rotating said stack of plates about said inclined axis, the number of plates being at least equal to the number of different sizes of coins to be sorted, a housing surrounding at least the periphery of said plates for keeping the coins being sorted thereon, each of said plates having a plurality of openings therein of a size slightly smaller than the size of the coins to be retained thereon, the openings in said plates increasing in size from the bottommost plate upwardly to the topmost plate, a coin entry chute disposed upon the uppermost plate for depositing a mixture of different sizes of coins thereon, coin receiving pockets arranged around each plate adjacent to the outer periphery thereof for catching a coin along the lower portion of the path of travel of said plate and for carrying the coin upwardly and past the highest portion of the path of travel of said plate, a plurality of discharge openings through said housing respectively associated with each of said plates and disposed adjacent to the outer periphery of the associated plate just below the highest portion of the path of travel thereof to receive the coins carried by said pockets one-by-one thereinto, coin ejection means for each of said plates adjacent to said discharge openings for moving coins one-by-one from said pockets and into the associated discharge opening, means for detecting an interruption in the rotation of said plates in the event of a jam of the coins carried thereon, and motor control means coupled to said detecting means and responsive to detection of an interruption in the rotation of said plates for thereafter reversing the direction of the rotation of said drive motor to clear the jam and permit continued rotation of said plates and continued operation of said coin counter.

11. The coin sorter set forth in claim 10, wherein said rotation interruption detecting means includes a disc rotating with said stack of plates and having a plurality of openings therein, a detector mounted adjacent to said disc for detecting the passage of the openings by said detector as said disc rotates.

12. The coin sorter set forth in claim 11, wherein said detector comprises a source of light positioned to shine through the openings in said disc and a light detector for detecting the passage of light through the openings in said disc.

13. A coin sorter comprising a stack of plates mounted for rotation about an axis inclined to the horizontal, the number of plates being at least equal to the number of different sizes of coins to be sorter, a housing surrounding at least the periphery of said plates for keeping the coins being sorted thereon, each of said plates having a plurality of openings therein of a size slightly smaller than the size of the coins to be retained thereon, the openings in said plates increasing in size from the bottommost plate upwardly to the topmost plate, a coin entry chute disposed upon the uppermost plate for depositing a mixture of different sizes of coins thereon, coin receiving pockets arranged around each plate adjacent to the outer periphery thereof for catching a coin along the lower portion of the path of travel of said plate and for carrying the coin upwardly and past the highest portion of the path of travel of said plate, a plurality of discharge openings through said housing respectively associated with said plates, each discharge opening being disposed adjacent to the outer periphery of the associated plate just below the highest portion of the path of travel thereof to receive the coins carried by said pockets one-by-one thereinto, and a plurality of resilient wheels each rotatably mounted above one of said plates adjacent to the associated discharge opening and engaging the upper surfaces of coins disposed in the pockets for moving the coins one-by-one from the pockets and into the associated discharge opening, each of said wheels being in contact with the associated plate and driven thereby so that the portion of the wheel in contact with the coin in a recess adjacent to the associated discharge opening moves outwardly with respect to the associated plate.

14. A coin sorter comprising a stack of plates mounted for rotation about an axis inclined to the horizontal, the number of plates being at least equal to the number of different sizes of coins to be sorted, a housing surrounding at least the periphery of said plates for keeping the coins being sorted thereon, each of said plates having a plurality of openings therein of a size slightly smaller than the size of the coins to be retained thereon, the openings in said plates increasing in size from the bottommost plate upwardly to the topmost plate, a coin entry chute disposed upon the uppermost plate for depositing a mixture of different sizes of coins thereon, coin receiving pockets arranged around each plate adjacent to the outer periphery thereof for catching a coin along the lower portion of the path of travel of said plate and for carrying the coin upwardly and past the highest portion of the path of travel of said plate, a plurality of discharge openings through said housing respectively associated with said plates, each discharge opening being disposed adjacent to the outer periphery of the associated plate just below the highest portion of the path of travel thereof to receive the coins carried by said pockets one-by-one thereinto, and a plurality of resilient wheels each rotatably mounted above one of said plates adjacent to the associated discharge opening and engaging the upper surfaces of coins disposed in the pockets for moving the coins one-by-one from the pockets and into the associated discharge opening, each of said wheels being canted with respect to the surface of the associated plate with the portion of the wheel on the leading side in contact with the associated plate and the portion of the wheel on the trailing side being spaced from the associated plate.

15. The coin sorter set forth in claim 14, wherein each of said wheels is in contact with the associated plate and is driven thereby so that the portion of the wheel in contact with the coin in a pocket adjacent to the associated discharge opening is moving outwardly with respect to the associated plate.

16. The coin sorter set forth in claim 14, and further comprising means resiliently urging each wheel independently of the other wheels against the associated plate.

17. The coin sorter set forth in claim 14, wherein each of said pockets is generally rectangular in shape.

18. The coin sorter-counter of claim 14, and further including a plurality of coin sensors respectively associated with said discharge openings and sensing and counting the coins as the coins pass through said discharge openings.

19. A coin sorter comprising a stack of plates mounted for rotation about an axis inclined to the horizontal, the number of plates being at least equal to the number of different sizes of coins to be sorted, a housing surrounding at least the periphery of said plates for keeping the coins being sorted thereon, each of said plates having a plurality of openings therein of a size slightly smaller than the size of the coins to be retained thereon, the openings in said plates increasing in size from the bottommost plate upwardly to the topmost plate, a coin entry chute disposed upon the uppermost plate for depositing a mixture of different sizes of coins thereon, coin receiving pockets arranged around each plate adjacent to the outer periphery thereof for catching a coin along the lower portion of the path of travel of said plate and for carrying the coin upwardly and past the highest portion of the path of travel of said plate, a plurality of discharge openings through said housing respectively associated with said plates, each discharge opening being disposed adjacent to the outer periphery of the associated plate just below the highest portion of the path of travel thereof to receive the coins carried by said pockets one-by-one thereinto, and a plurality of resilient wheels each rotatably mounted above one of said plates adjacent to the associated discharge opening and engaging the upper surfaces of coins disposed in the pockets for moving the coins one-by-one from the pockets and into the associated discharge openings, and means resiliently urging each wheel independently of the other wheels against the associated plate.

20. A coin sorter comprising a stack of plates mounted for rotation about an axis inclined to the horizontal, the number of plates being at least equal to the number of different sizes of coins to be sorted, a housing surrounding at least the periphery of said plates for keeping the coins being sorted thereon, each of said plates having a plurality of openings therein of a size slightly smaller than the size of the coins to be retained thereon, the openings in said plates increasing in size from the bottommost plate upwardly to the topmost plate, a coin entry chute disposed upon the uppermost plate for depositing a mixture of different sizes of coins thereon, coin receiving pockets arranged around each plate adjacent to the outer periphery thereof for catching a coin along the lower portion of the path of travel of said plate and for carrying the coin upwardly and past the highest portions of the path of travel of said plate, a plurality of discharge openings through said housing respectively associated with said plates, each discharge opening being disposed adjacent to the outer periphery of the associated plate just below the highest portion of the path of travel thereof to receive the coins carried by said pockets one-by-one thereinto, a plurality of resilient wheels each rotatably mounted above one of said plates adjacent to the associated discharge opening and engaging the upper surfaces of coins disposed in the pockets for moving the coins one-by-one from the pockets and into the associated discharge opening, a motor for rotating said stack of plates about said inclined axis, and an overload coin sensor associated with each of said plates for detecting a quantity of coins on the associated plate sufficient to overload the coin sorter and for stopping the drive motor so that the overload condition can be corrected.

21. The coin sorter-counter set forth in claim 20, wherein each of said overload coin sensors is mounted in said housing a predetermined distance above the associated plate for detecting an overload condition on the associated coin plate.

22. The coin sorter-counter set forth in claim 20, wherein each overload coin sensor when sensing an overload of coins on the associated plate grounds the armature of said drive motor to stop said drive motor.

23. The coin sorter-counter set forth in claim 20, and further comprising an alarm operatively connected to said overload coin sensors for alarming the operator when an overload condition is detected.

* * * * *